US005926162A

United States Patent [19]

Wood et al.

[11] Patent Number: 5,926,162

[45] Date of Patent: Jul. 20, 1999

[54] COMMON ELECTRODE VOLTAGE DRIVING CIRCUIT FOR A LIQUID CRYSTAL DISPLAY

[75] Inventors: Teddy J. Wood; Bill A. Dickey, both of Corrales, N.M.

[73] Assignee: Honeywell, Inc., Minneapolis, Minn.

[21] Appl. No.: 08/775,433

[22] Filed: Dec. 31, 1996

[51] Int. Cl.[6] ..... G09G 3/36

[52] U.S. Cl. ..... 345/101; 345/94; 345/90

[58] Field of Search ..... 345/92, 93, 94, 345/95, 101, 98, 90, 102, 205, 206, 208

[56] References Cited

U.S. PATENT DOCUMENTS

| | | | |
|---|---|---|---|
| 5,159,326 | 10/1992 | Yamazaki et al. | 345/101 |
| 5,537,129 | 7/1996 | Okada et al. | 345/90 |
| 5,686,932 | 11/1997 | Tomita | 345/94 |

FOREIGN PATENT DOCUMENTS

| | | | |
|---|---|---|---|
| 0558060A2 | 2/1993 | European Pat. Off. | G09G 3/36 |
| 082262413 | 10/1996 | Japan | G02F 1/133 |
| 08278485 | 10/1996 | Japan | G02F 1/133 |

*Primary Examiner*—Richard A. Hjerpe
*Assistant Examiner*—Francis N. Nguyen
*Attorney, Agent, or Firm*—Andrew A. Abeyta; Kenneth J. Johnson

[57] ABSTRACT

A control circuit for providing a common electrode voltage for a liquid crystal display dynamically controls the voltage applied to the common electrode according to various factors that affect the capacitance across the liquid crystal layer. The common electrode control circuit dynamically adjusts the common electrode voltage according to the current maximum and minimum display voltages. In addition, the common electrode control circuit adjusts the common electrode voltage according to the gate-to-source parasitic capacitance, as well as temperature fluctuations. Thus, the control circuit compensates for the most significant factors which may cause he inadvertent accumulation of a charge across the liquid crystal layer.

20 Claims, 5 Drawing Sheets

COMMON ELECTRODE VOLTAGE DRIVING CIRCUIT FOR A LIQUID CRYSTAL DISPLAY

BACKGROUND OF THE INVENTION

1. Field of the Invention

The present invention relates to liquid crystal displays, and more particularly, to a system and method for controlling a voltage applied to a common electrode of a liquid crystal display.

2. Description of the Related Art

Liquid crystal displays (LCDs) have become common in a wide variety of applications due to their modest space and power requirements. These characteristics make LCDs very useful in spatially-sensitive and low power applications, such as portable computers, miniature televisions, aircraft, spacecraft, and portable sensors. As LCDs develop further, more applications are likely to incorporate many types of LCD technology.

In general, a typical LCD comprises a layer of liquid crystal sandwiched between two substrates. The LCD is subdivided into pixels, which are addressable via multiple display electrodes formed on one of the substrates. The second substrate, on the other hand, includes a single, relatively large electrode formed on the surface closest to the liquid crystal layer. The electrode serves as a counter electrode, often referred to as the common electrode, to form a capacitance with each of the display electrodes across the liquid crystal layer. When the addressable display electrodes are charged relative to the common electrode using the appropriate signals, the opacity of the liquid crystal changes according to the magnitude of the potential across the liquid crystal. Thus, by providing the appropriate display signals to the various display electrodes, images may be formed on the LCD.

Because the magnitude of the voltage across the liquid crystal layer determines the transmissivity of the pixel, the voltage applied to the common electrode is controlled to ensure the that desired image is formed on the display. Typically, the common electrode is connected to a regulated power supply and a resistive divider to maintain a substantially constant voltage. All of the display electrodes may then be driven with display signals, using the single, constant voltage applied to the common electrode as a reference voltage.

Although controlling the common electrode voltage tends to supply a steady reference voltage for the display signals, a charge differential may be inadvertently formed between the display electrodes and the common electrode and inadvertently change the display. For example, when the same image is maintained on the LCD for an extended period, charge may accumulate across the liquid crystal layer that it may not fully discharge when the image changes. This tends to result in long-term image retention, in which the previous image is still displayed on the LCD even after different data signals for subsequent images are applied. This not only degrades the quality of the image provided by the LCD, but the accumulation of charge may diminish the life of the LCD.

To minimize such undesirable effects, most video systems drive LCDs with alternating current (AC) signals. Specifically, the polarities of the drive signals are periodically reversed, for example for every frame. Thus, the polarity of the potential to be applied between the display electrode and the common electrode in one frame period is opposite to the polarity of the preceding frame period. The voltage applied to the common electrode is set to the midpoint voltage between the peak positive and negative signal voltages provided by the display driver circuit. Consequently, any charge remaining on a display electrode from a signal of one polarity should be negated by the following signal of opposite polarity.

Despite the application of AC signals to the display electrodes, however, a charge differential may nevertheless form across the liquid crystal layer due to variations in the magnitude of the display signals. For example, the power provided by the display signals may occasionally deteriorate under high loading conditions. Consequently, the mean voltage of the display signals tends to drift away from the midpoint between the original peak magnitudes, which is the voltage applied to the common electrode. As a result, a positive or negative charge with respect to the common electrode may accumulate on the display electrodes and degrade the display.

In addition, other characteristics of LCDs may contribute to the retention of voltage across the liquid crystal layer. In particular, display signals are typically supplied to each display electrode using a switching device dedicated to each pixel, commonly a thin film transistor (TFT). The TFTs, however, commonly exhibit a parasitic capacitance between the gate and the source. The magnitude of the parasitic capacitance is usually related to the structure of the TFT, and thus varies according to the individual display's structure. These parasitic capacitances tend to divide the voltage applied to the gate of the TFT, thus changing the effective voltage applied to the gate by the display signal. As a result, the display electrode may not completely charge or discharge in response to a display signal based on the reference potential of the common electrode.

Residual voltage retained on the display electrode may also be attributable to temperature variations of the liquid crystal layer. In particular, the temperature of the liquid crystal layer affects its capacitance, which further affects the characteristics of the capacitive divider formed by the gate and source parasitic capacitance. As a result, variations in the temperature of the liquid crystal layer due to ambient conditions, power supply, or backlighting may contribute to the retention of charge across the electrodes.

SUMMARY OF THE INVENTION

In accordance with various aspects of the present invention, a circuit for driving a common electrode dynamically controls the voltage applied to the common electrode according to factors that affect the voltage across the liquid crystal layer. In one embodiment, the common electrode control circuit dynamically adjusts the common electrode voltage according to the current maximum and minimum display circuit voltages. In addition, the common electrode control circuit adjusts the common electrode voltage according to the effect of the capacitive divider formed by the gate-to-source parasitic capacitance, as well as to compensate for variations in the capacitance of the liquid crystal layer caused by temperature fluctuations. Thus, in accordance with the present invention, the primary variables which may cause the inadvertent accumulation of a charge differential across the liquid crystal layer are used to control the voltage on the common electrode. Consequently, the voltage components inadvertently applied across the liquid crystal cell tend to diminish.

BRIEF DESCRIPTION OF THE DRAWING FIGURES

The subject matter of the invention is particularly pointed out and distinctly claimed in the concluding portion of the specification. The invention, however, both as to organization and method of operation, may best be understood by reference to the following description taken in conjunction with the claims and the accompanying drawing, in which:

DETAILED DESCRIPTION OF A PREFERRED EXEMPLARY EMBODIMENT

Figure 1:
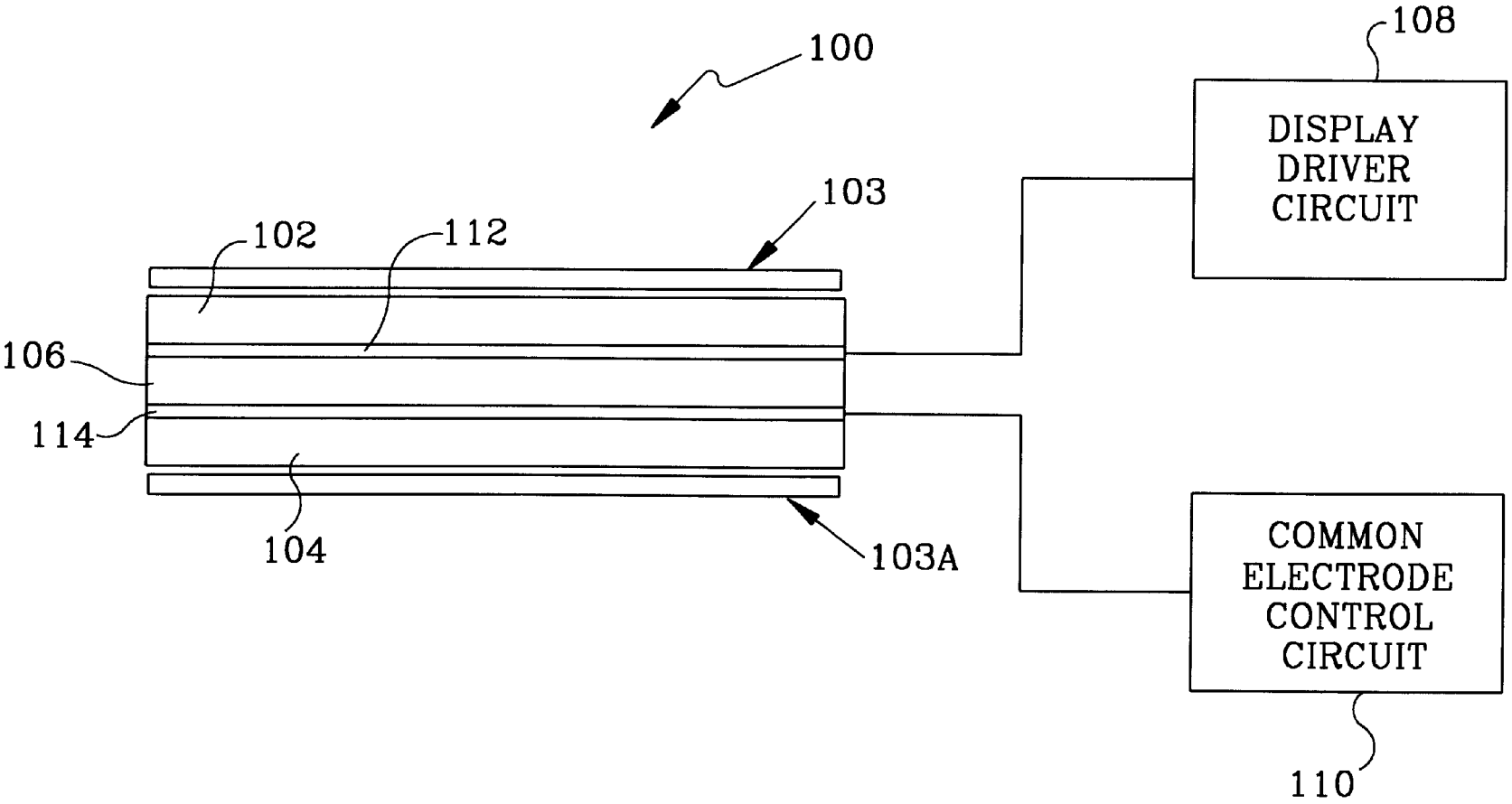
FIG. 1 is a diagram of an exemplary configuration of an LCD and corresponding control circuits.

Referring to FIG. 1, a liquid crystal display (LCD) 100 suitably comprises a display substrate 102; a counter substrate 104; a layer of liquid crystal 106 between the substrates 102, 104; a display driver circuit 108; and a common electrode control circuit 110. The display substrate 102 and counter substrate 104 are disposed so as to oppose each other and have a narrow gap between them in which the liquid crystal layer 106 is disposed. Each substrate 102, 104 suitably comprises a transparent material, such as glass or acrylic and has a respective polarizer 103, 103A covering the exterior surface. The liquid crystal layer 106 comprises of any suitable material having selective transmissivity due to polarization characteristics in response to a field applied across the liquid crystal layer 106. The LCD 100 suitably comprises a twisted nematic mode, supertwisted nematic mode, or active matrix twisted nematic LCD. In the present embodiment, however, the LCD 100 is an active matrix twisted nematic LCD. It should be noted that the present LCD 100 is only one potential configuration of an LCD in accordance with various aspects of the present invention. In addition, the LCD may further include components typically associated with a display system, such as any required power source, memory requirements, and the like, although not shown in FIG. 1 and are not described herein.

The display substrate 102 suitably includes a display electrode array 112 formed on one of its surfaces, preferably the surface nearest the liquid crystal layer 106. Similarly, the counter substrate 104 includes at least one common electrode 114 formed on one of its surfaces, preferably the surface adjacent the liquid crystal layer 106. The display electrode array 112 is connected to the display driver circuit 108, and the common electrode 114 is connected to the common electrode control circuit 110. The display driver circuit 108 and the common electrode control circuit 110 control the signals applied to the respective electrodes 112, 114 and selectively change the transmissivity of the liquid crystal layer 106 in conjunction with the polarizer at various locations, thus facilitating the formation of images on the LCD 100.

Figure 2:
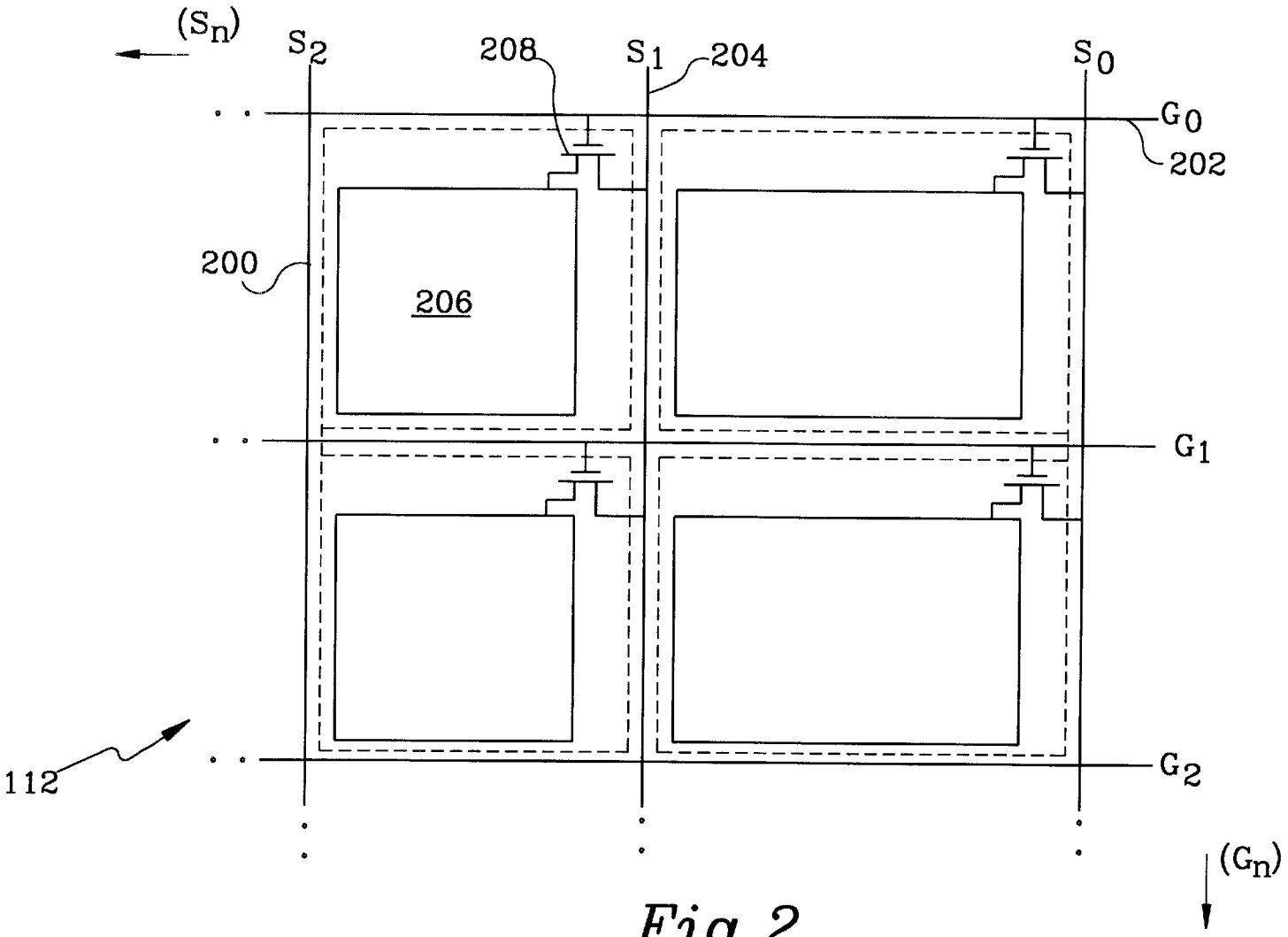
FIG. 2 is a diagram of an exemplary display electrode array for an LCD.

More particularly, referring now to FIG. 2, the display electrode array 112 suitably comprises a plurality of addressable pixels 200, suitably formed in a grid pattern. The display electrode array 112 suitably includes a plurality of row electrodes 202 and a plurality of column electrodes 204 formed on the surface of the display substrate 102 so that the row electrodes 202 are orthogonal to the column electrodes 204. The row and column electrodes 202, 204 are comprised of a suitable electrically conductive material, such as indium-tin-oxide (ITO). Each combination of a particular row electrode 202 and a particular column electrode 204 corresponds to a single pixel 200. Each pixel 200 suitably includes a display electrode 206, also comprised of a suitably electrically conductive material which is addressable via the appropriate combination of row and column electrodes 202, 204. Preferably, the display electrode 206 is composed of a substantially transparent material, such as a patterned ITO film, to transmit visible light through the LCD 100.

Figure 3:
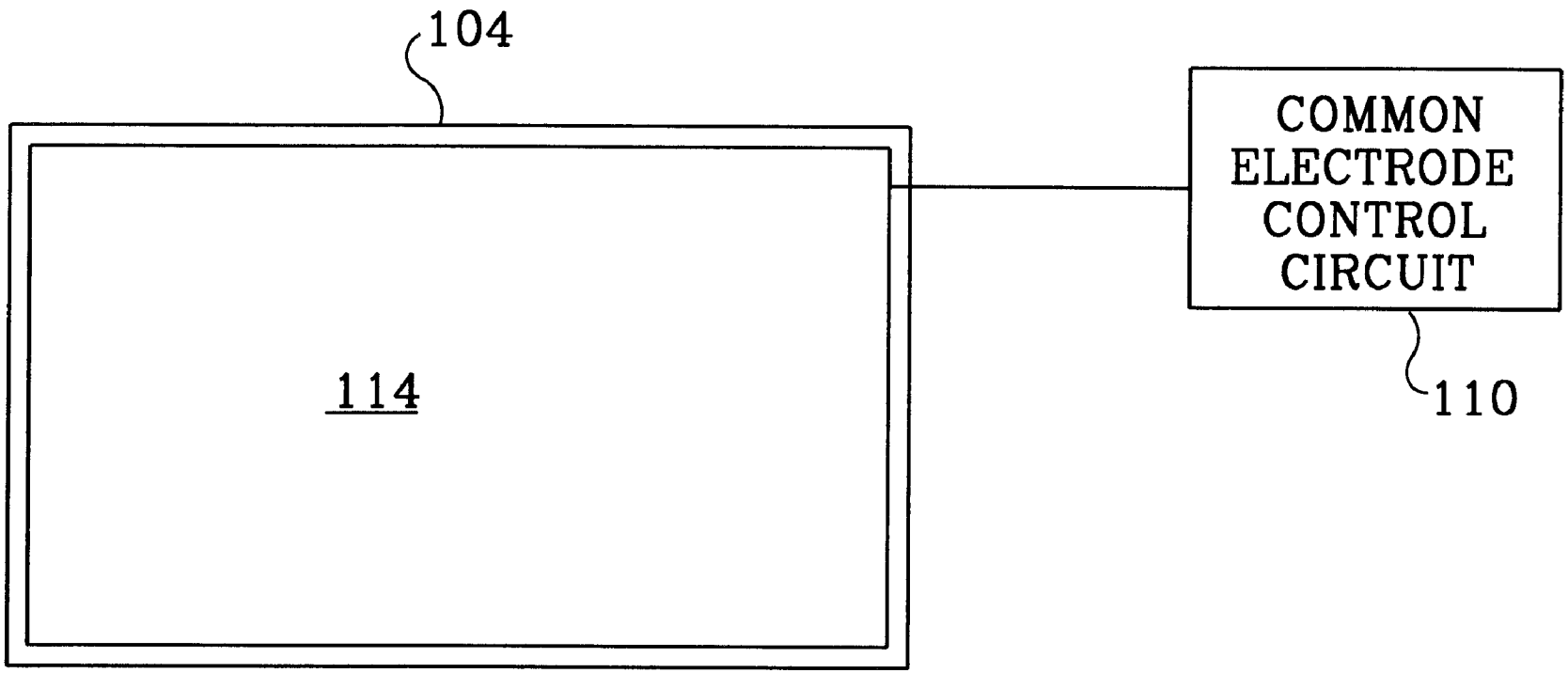
FIG. 3 is a diagram of a common electrode on a counter substrate and a corresponding common electrode control circuit.

The display electrode 206 is connected to the corresponding row electrode 202 and column electrode 204 via a switching element. The switching element is suitably configured to facilitate the selective charging and discharging of the display electrode 206 via the row and column electrodes 204. In the present embodiment, the switching element suitably comprises a thin film transistor (TFT) 208, though any suitable switching element may be provided and suitably configured. For example, a gate of the TFT 208 is connected to the row electrode 202, a source is connected to the column electrode 204, and a drain is connected to the display electrode 206. Thus, the charge applied to the display electrode 206 may be selectively adjusted by providing signals to the row and column electrodes 202, 204. The signal applied to the gate of the TFT 208 via the row electrode 202 controls whether current flows between the drain and source of the TFT 208, and the signal applied to the source via the column electrode 204 controls the amount of charge transmitted to the display electrode 206. In contrast to the display electrode array 112, a single reference voltage is suitably applied to the common electrode 114. The common electrode 114, however, may be configured in any suitable manner. For example, the common electrode 114 may be separated into a grid of multiple elements scattered across the surface of the counter substrate 104, or a single electrode formed across the entire surface of the counter substrate 104, as shown in FIG. 3. The common electrode 114 may be comprised of any suitable substantially transparent material for conducting electricity and compatible with the particular application of the LCD 100.

Because each of the display electrodes 206 is positioned opposite at least a portion of the common electrode 114 across the liquid crystal layer 106, each of the display electrodes 206 forms a cell capacitor in conjunction with the common electrode 114, with the interposed liquid crystal layer 106 material serving as a dielectric material. Although a display electrode 206 is associated with each of the pixels 200, the common electrode 114 on the counter substrate 104 provides a reference voltage for all of the pixels 200. Thus, by changing the voltage applied to each display electrode 206 with respect to the voltage applied to the common electrode 114, fields may be selectively formed across the liquid crystal layer 106 at discrete locations. The formation of a field causes a corresponding realignment of the molecules of the liquid crystal layer 106, altering the optical transmissivity in conjunction with the polarizers of the layer adjacent the pixel 200 and facilitating the formation of an image.

The charge associated with each display electrode 206, and thus the image formed on the LCD 100, is controlled by the display driver circuit 108. The display driver circuit 108 suitably comprises any display driver circuit 108 configured to drive the LCD 100. The display driver circuit 108 suitably provides signals to the various pixels 200 formed on the display substrate 102 to control the amount of charge on the individual display electrodes 206.

In particular, to display an image on the LCD 100, the display driver circuit 108 sequentially selects individual row electrodes 202 through which it applies a selected gate drive signal $G_n$ to the gates of the respective TFTs 208. The TFTs 208 connected to the selected row electrode 202 are activated by the gate drive signal $G_n$ so that each display electrode 206 associated with one of the activated TFTs 208 is electrically connected to the corresponding column electrode 204 across the drain and source of the TFT 208. Substantially simultaneously with the application of the gate drive signal $G_n$, the display driver circuit 108 applies suitable source drive signals $S_n$ to the column electrodes 204. The voltage levels of the source drive signals $S_n$ applied to the column electrodes 204 are determined based on video signals which have been input to the display driver circuit 108. As a result, the voltage applied to the corresponding column electrode 204 transfers charge to or from the associated display electrode 206 via the drain and source of the TFT 208.

Thus, at the pixels 200 connected to the activated row electrodes 202, the charges on the display electrodes 206 are determined according to the source drive signals $S_n$. The remaining display electrodes 206, however, remain unaffected, as only the TFTs 208 in the selected row have been activated. As a result, a selected potential difference may be applied between the display electrode 206 and the common electrode 114 for each pixel 200. Thus, in the corresponding portions of the liquid crystal layer 106, optical transmission in conjunction with the polarizers is appropriately changed in accordance with the level of the applied potential difference so that a certain amount light is transmitted through the display substrate 102. By sequentially selecting and driving all of the pixels 200, an image may be displayed on the LCD 100.

In an LCD 100 according to various aspects of the present invention, the voltage applied to the common electrode 114 is controlled by the common electrode control circuit 110. The common electrode control circuit 110 is configured to dynamically adjust a voltage applied to the common electrode 114 in accordance with selected variables to counteract the inadvertent accumulation of charge across the liquid crystal layer 106. In particular, the common electrode control circuit 110 is suitably configured to provide a voltage to the common electrode 114 according to an average of the peak voltages associated with the display signals applied to the LCD 100, a parasitic capacitance between the gate and source of each TFT 208, and the current temperature of the liquid crystal layer 106.

Figure 4:
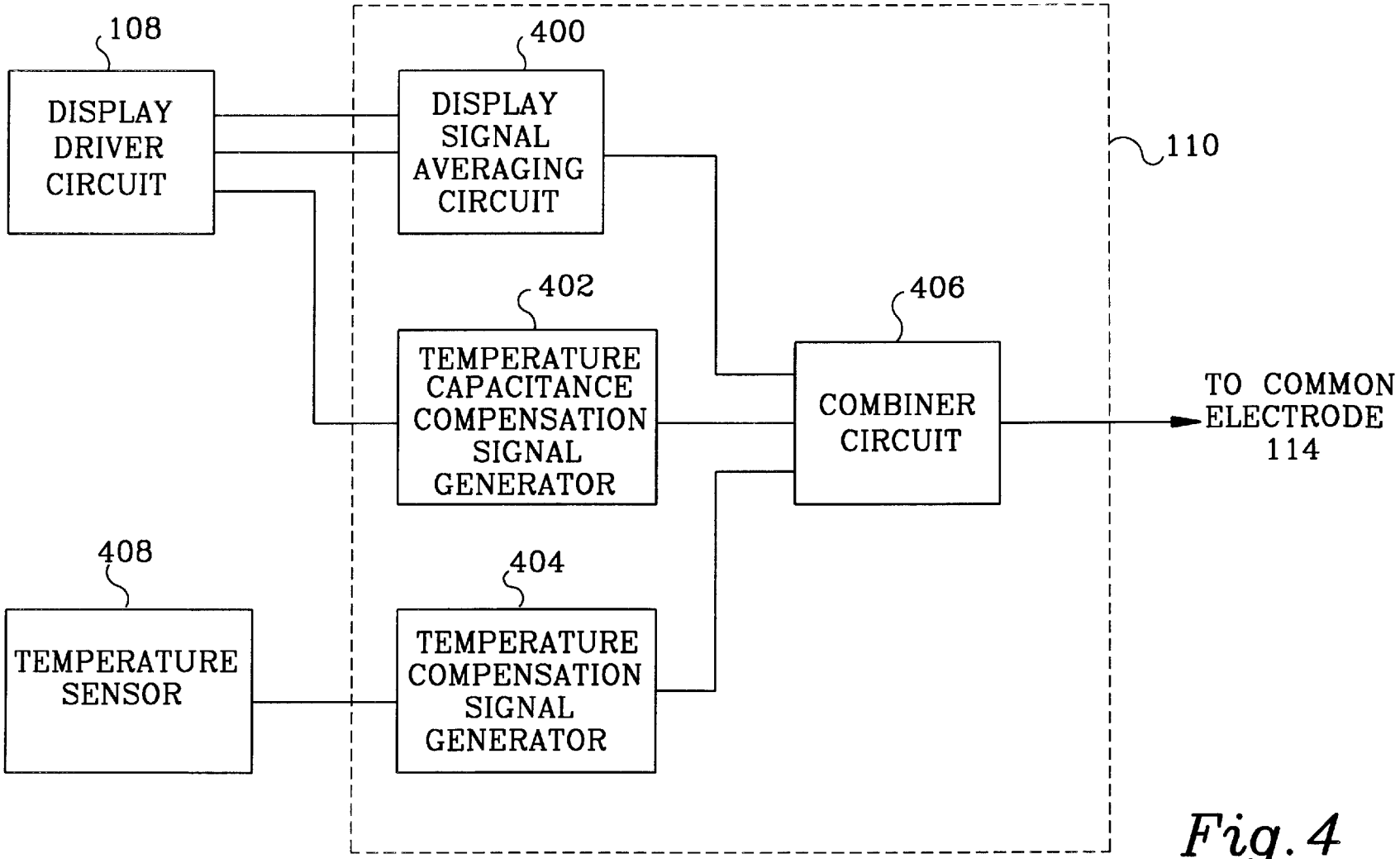
FIG. 4 is a block diagram of a common electrode control circuit according to various aspects of the present invention.

For example, referring now to FIG. 4, a suitable common electrode control circuit 110 comprises a display signal averaging circuit 400 responsive to the display driver circuit 108; a parasitic capacitance signal generator 402 responsive to the gate voltage and the parasitic capacitances of the TFTs 208; a temperature signal generator 404 responsive to the temperature of the liquid crystal layer 106; and a combiner circuit 406. The display signal averaging circuit 400, the parasitic capacitance compensation signal generator 402, and the temperature compensation signal generator 404 generate signals corresponding to the variables that most significantly affect inadvertent charge accumulation in the pixels 200. Thus, the common electrode control circuit 110 applies a voltage to the common electrode 114 in accordance with the signals to minimize the inadvertent accumulation of a voltage potential across the liquid crystal layer 106.

Figure 5:
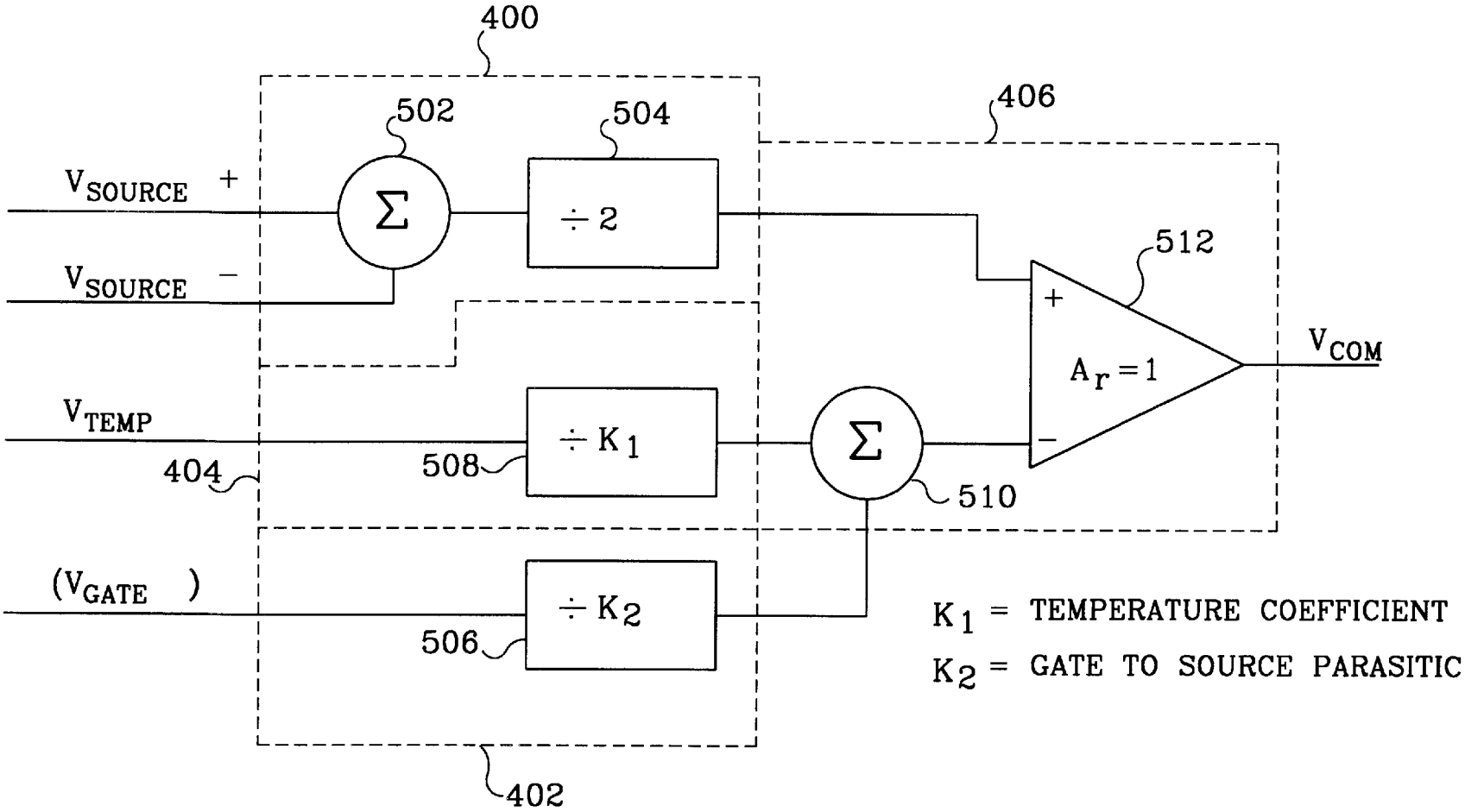
FIG. 5 is a schematic diagram of a common electrode control circuit according to various aspects of the present invention.

In particular, the display signal averaging circuit 400 is suitably configured to determine a null voltage, suitably an average of the minimum and maximum values of the source drive signals $S_n$ applied to the column electrodes 204. For example, referring now to FIGS. 4 and 5, the display signal averaging circuit 400 suitably comprises a display summing circuit 502 and an averaging divider circuit 504. The display summing circuit 502 adds the magnitudes of the maximum and minimum signals to be applied to the LCD 100 for both the positive and negative polarity modes of the source drive signals $S_n$. A display driver circuit 108 driving a normally white display, for example, applies a maximum voltage to a particular column electrode 204 to drive a particular pixel 200 fully black in the positive polarity mode. Conversely, the display driver circuit 108 applies a minimum voltage to the column electrode 204 to drive the pixel 200 fully black in the negative polarity mode. Similar maximum and minimum voltages are applied for driving a normally black pixel 200 fully white for each polarity mode.

The minimum and maximum source drive signals $S_n$ may be generated in any suitable manner according to the configuration of the LCD 100. For example, the maximum and minimum source drive signals $S_n$ can be directly obtained from the display driver circuit 108 which generates the source drive signals $S_n$. Alternatively, they may be obtained through a feedback circuit from the output of the display driver circuit 108. The magnitude and type of the signals applied to the display summing circuit 502 can be the same as the actual levels of the source drive signals $S_n$ voltages, or may be any processed signals corresponding to the source drive signal $S_n$ minimum and maximum drive voltages.

In accordance with a preferred aspect of the present invention, a main point in the acquisition of the null component of the common plane voltage which is the output of 504 is to obtain the average, the output of 502 of the minimum and maximum voltage drive to the source lines (V source − and V source +) the input to 502 of the LCD. The method for determining the V source − and V source + drive voltages to the source lines is dependent on the method the source driver chip uses to either apply or generate the source voltages. Some types of drivers apply the minimum and maximum reference voltages from external supply circuitry, while other types of drivers generate the minimum and maximum reference voltages internally. Preferably, the method of determining the null component of the common plane voltage involves utilizing a spare output or outputs of a source driver or drivers and sampling them at a controlled input value to generate the V source − and V source + reference voltages at the output, then averaging them for the null component of the common plane voltage.

The minimum and maximum source reference voltage can be obtained a variety of different ways. Preferably, the method is primarily determined by the type of LCD source driver used on the display. Source drivers are generally one of four design types; cross point switches, sampled analog references, Digital to Analog Converts (DAC), and direct analog sampling.

The cross point switch source drivers accept a digital word and use it to select one of a number of precision references supplies also supplied to the source drivers. This embodiment would be served by determining the V source + and V source − reference voltages at the voltage regulator and averaging for the null voltage component.

The sampled analog references drivers (also known as sampled ramps drivers) accept a digital input and uses it to select a time when the precision analog reference waveform is at the desired value. The analog reference or ramp, is also supplied to the source driver. Preferably, the V source + and V source − reference values are determined by using controlled sample and hold circuits in the analog reference voltage generation, coupled with averaging to determine the null component. The V source + and V source − reference sources could also be determined using positive and negative peak detectors and then averaging for the null voltage component.

The digital to analog converter source drivers accept a digital input and use it to generate precision reference voltage directly to the source drivers output. Preferably, this embodiment utilizes determining the V source + and V source − reference sources for the DAC and averaging for the null voltage component.

The direct analog sample source drivers accept and amplify the alternatively inverted analog input waveform that is representative of the desired value supplied to the source driver. The source driver samples the input waveform at the appropriate time corresponding to the driver outputs physical location to provide the display with the desired value. This embodiment tends to require determining the V source + and V source − for a sample of the output driver and using positive and negative peak detectors on the sampled output and then averaging for the null voltage component.

The levels of the maximum and minimum voltages are provided the display summing circuit 502, which adds the voltage levels to generate a sum signal. The summed signal is then provided to the averaging divider circuit 504, suitably a voltage divider, to divide the sum signal by two to generate an average. The averaging divider circuit 504, however, may be implemented in any appropriate configuration to establish a baseline null voltage for the common electrode 114 according to the source drive signals $S_n$.

The parasitic capacitance compensation signal generator 402, on the other hand, suitably generates a signal corresponding to the effect of the parasitic capacitances between the gates and sources of the TFTs 208 on the gate drive signals $G_n$ applied to the gates. Because the parasitic capacitance operates as a divider between the gate and source, the appropriate common electrode voltage is inversely proportional to the magnitude of the gate drive signal $G_n$ generated by the display driver circuit 108. Thus, the common electrode control circuit 110 suitably receives a signal representative of the gate drive signal $G_n$ generated by the display driver circuit 108, and inversely proportionally adjusts the voltage applied to the common electrode 114.

In the present embodiment, the parasitic capacitance compensation signal generator 402 provides a signal based on the present gate drive signal $G_n$ voltage and generates a signal to compensate for the gate-to-source parasitic capacitance's effect as the gate drive signal $G_n$ is applied to the gates of the TFTs 208. For example, the gate drive signal $G_n$ is suitably rectified. Any suitable rectifier (not shown) may be provided to rectify the AC gate drive signal $G_n$. The gate drive signal $G_n$ may be directly obtained from the display driver circuit 108, or may be obtained through a feedback circuit from the output of the display driver circuit 108 of the LCD 100. The signal provided to the parasitic capacitance signal generator 402 is suitably the actual gate drive signal $G_n$, or it may be any processed signal which represents or corresponds to the gate drive signal $G_n$.

The rectified signal is provided to a parasitic capacitance compensation circuit 506, which divides the rectified signal by a suitable gate parasitic constant. The gate parasitic constant is determined based on the LCD 100 configuration, suitably at the factory when the LCD 100 is assembled, and is typically in the range of approximately 10. Gate parasitic capacitance is primarily affected by the misalignments which occur during manufacture of the TFT. For example, the gate parasitic constant may be a function of the thickness of the gate insulator and the TFT 208 alignment, both of which are set during the fabrication process of the LCD 100. Gate parasitic capacitance is primarily affected by the misalignments which occur during manufacture of other TFT. Primary factors in the parasitic gate constant are: variation in $C_{as}$ due to manufacturing tolerance variation in $C_{storage}$ due to manufacturer tolerance variation in gate drive voltage (peak-to-peak) rate of change in gate drive voltage ($C^{dV}/_{dC}$). Consequently, the gate parasitic constant is suitably adjustable so that the appropriate value for the constant may be determined when the LCD 100 is assembled and then set accordingly. Alternatively, any other suitable mechanism may be provided to determine the appropriate gate parasitic constant and generate the appropriate parasitic capacitance compensation signal. Thus, any LCD 100 may be individually adjusted to operate using the appropriate gate parasitic constant.

Similarly, the temperature signal generator 404 preferably generates a signal representative of the liquid crystal layer's 106 capacitance as a function of temperature. Variations in the liquid crystal layer's 106 temperature induce changes in the dielectric characteristic and resistance of the liquid crystal layer 106, thus causing changes in the cell capacitance and time constant between the display electrode 206 and the common electrode 114. The different dielectric characteristic may cause changes in a capacitive divider formed by gate, drain, and source parasitic capacitances and the capacitance of the liquid crystal layer. The temperature signal generator 404 generates a suitable signal for adjusting the common electrode 114 voltage according to variations in the temperature of the liquid crystal layer 106 to maintain the appropriate null voltage.

The temperature signal generator 404 receives signals from a temperature sensor 408 associated with the LCD 100. The temperature sensor 408 generates a raw temperature signal, which is supplied to the temperature compensation signal generator 404. The temperature sensor 408 comprises any suitable type of sensor for generating a signal corresponding to temperature, such as a commercially available thermocouple. The signal applied to the temperature compensation signal generator 404 suitably comprises the raw signal generated by the temperature sensor 408, or may comprise a processed signal corresponding to the signal generated by the temperature sensor 408. The signal generated by the temperature sensor 408 may be any sort of signal representative of or corresponding to the temperature of the liquid crystal layer 106. In the present embodiment, the temperature sensor 408 generates a signal having a voltage that varies substantially linearly with the temperature of the liquid crystal layer 106.

The signal received from the temperature sensor 408 is processed by the temperature compensation signal generator 404 to provide a signal corresponding to the temperature of the liquid crystal layer 106 and which may be used to control the voltage applied to the common electrode 114 accordingly. For example, the temperature signal generator 404 suitably includes a temperature divider circuit 508, such as a voltage divider circuit, which divides the signal received from the temperature sensor 408 by a temperature constant. The temperature constant suitably comprises a preselected constant based on the type of liquid crystal and the configuration of the LCD 100, and is typically in the range of 150 mV from −40° C. to +85° C.

The signals generated by the display signal averaging circuit 400, the parasitic capacitance compensation signal generator 402, and the temperature compensation signal generator 404 are provided to the combiner circuit 406. The combiner circuit 406 suitably comprises a circuit for controlling the voltage applied to the common electrode 114, for example according to the three signals received from the display signal averaging circuit 400, the parasitic capacitance compensation signal generator 402, and the temperature compensation signal generator 404. For example, the combiner circuit 406 may comprise a microprocessor-controlled circuit for controlling the common electrode 114 voltage according to a preselected algorithm and the signals received at its inputs.

In the present embodiment, however, the combiner circuit 406 suitably comprises a combiner summing circuit 510 and an amplifier 512. The parasitic capacitance compensation signal generator 402 and the temperature compensation signal generator 404 are connected to the combiner summing circuit 510, which suitably generates a signal corresponding to the sum of the two signals. The combiner summing circuit 510 comprises any suitable summing circuit.

The summed signal from the combiner summing circuit 510 and the display average signal from the display signal averaging circuit 400 are provided to the amplifier 512, which generates an appropriate common electrode 114 voltage in accordance with the combiner summed signal and the display average signal. In the present embodiment, the amplifier 512 comprises a conventional operational amplifier having a noninverting input and an inverting input. The display average signal is provided to the noninverting input and the combiner summed signal is provided to the inverting input.

The amplifier 512 is suitably configured for a gain of unity, such that the amplifier 512 generates a combiner signal corresponding to the display average signal less the summed signal from the combiner summing circuit 510. The combiner signal may then be applied to the common electrode 114. Alternatively, the combiner signal may be provided to appropriate circuitry, such as filtration and amplifier circuitry, to develop the signal to be applied to the common electrode 114 according to the combiner signal. Thus, the common electrode 114 voltage is adjusted to compensate for the variations in the common electrode 114 voltage derived from the primary factors.

In this configuration, the common electrode control circuit 110 dynamically adjusts the voltage applied to the common electrode 114 according to the most significant factors that influence the inadvertent creation of a charge differential across the liquid crystal layer 106. The common electrode control circuit 110 monitors the maximum and minimum signals for driving the LCD 100 provided by the display driver circuit 108. If the levels of the source drive signals $S_n$ drop, for example due to an overloaded power supply, the common electrode control circuit 110 automatically adjusts the voltage applied to the common electrode 114 so that the common electrode voltage is the average of the maximum and minimum source drive signals $S_n$.

In addition to monitoring the source drive signals $S_n$, the common electrode control circuit is further configured to adjust the common electrode voltage to compensate for parasitic capacitances and variations in the capacitance of the liquid crystal layer. In particular, the gate drive signals $G_n$ are monitored by the common electrode control circuit 110 to determine the magnitude of the divider formed between the gate and source of the TFT 208. The voltage applied to the common electrode 114 is adjusted proportionally to compensate for the actual voltage applied to the gate. Similarly, as the temperature of the liquid crystal layer varies, the common electrode control circuit 110 monitors the temperature and corrects the voltage applied to the common electrode 114 accordingly.

In the above-described driving circuit of the present invention, the primary input variables which may generate the need for a specific change in the common electrode 114 voltage are used for establishing the common electrode 114 signal. Thus, it becomes possible to control the common electrode 114 voltage while tracking the error-inducing changes of the voltage level to reduce them. This reduces the chance for a long-term image retention, and improves the performance of the LCD 100 over temperature. In addition, life of the LCD 100 may be prolonged.

The various embodiments were chosen and described in order to explain the principles of the invention and its practical application to enable others of ordinary skill in the art to best utilize the invention in various embodiments and with various modifications as are suited to the particular use contemplated. It is intended that the scope of the invention be defined by the claims attached hereto.

We claim:

1. A liquid crystal display, comprising:

a first substrate having at least one surface, wherein a display electrode is disposed on said first substrate surface;

a second substrate having at least one surface positioned adjacent to said first substrate, wherein a common electrode is disposed on said second substrate surface;

a liquid crystal layer disposed between said substrates;

a display driver circuit connected to said display electrode and configured to provide a desired charge to said display electrode through respective switching elements by which a drive signal is applied to the switching control of the respective switching devices, wherein said display electrode receives the desired charge and an error charge from the respective switching elements, the error charge being indicative of a parasitic capacitance of the switching control of the switching elements on the display electrode relative to a capacitance of the liquid crystal layer, and a magnitude of a difference between said desired charge and said error charge fluctuates; and a common electrode control circuit connected to said common electrode and configured to provide a common electrode signal to said common electrode, wherein said common electrode control circuit automatically and dynamically adjusts said common electrode signal according to said magnitude of said difference.

2. A liquid crystal display according to claim 1, wherein:

said display driver circuit is configured to generate display signals within a range of magnitudes, wherein said range of magnitudes is subject to a fluctuation, and wherein said magnitude of said difference fluctuates according to said fluctuation of said range of magnitudes; and said common electrode control circuit adjusts said common electrode signal according to said fluctuation of said range of magnitudes.

3. A liquid crystal display according to claim 2, wherein:

said display driver circuit is further configured to generate a gate signal having a variable magnitude, wherein said magnitude of said difference fluctuates according to said magnitude of said gate signal; and said common electrode control circuit adjusts said common electrode signal according to said fluctuation of said range of magnitudes and said magnitude of said gate signal.

4. A liquid crystal display according to claim 3, wherein:

said liquid crystal layer has a variable temperature; and said common electrode control circuit adjusts said common electrode signal according to said fluctuation of said range of magnitudes, said magnitude of said gate signal, and said temperature.

5. A liquid crystal display according to claim 1, wherein:

the drive signal is a gate signal having a variable magnitude, wherein said magnitude of said difference fluctuates according to said magnitude of said gate signal; and said common electrode control circuit adjusts said common electrode signal according to said magnitude of said gate signal.

6. A liquid crystal display according to claim 5, wherein:

said liquid crystal layer has a variable temperature; and said common electrode control circuit adjusts said common electrode signal according to said magnitude of said gate signal and said temperature.

7. A liquid crystal display according to claim 1, wherein:

said liquid crystal layer has a variable temperature; and said common electrode control circuit adjusts said common electrode signal according to said temperature.

8. A common electrode control circuit for controlling the voltage applied to a common electrode in a liquid crystal display having a display electrode, comprising:

a detector configured to identify a determine a difference between a desired charge on the display electrode and an actual charge on the display electrode; and a voltage controller responsive to the detector and connected to the common electrode, wherein said voltage controller is configured to adjust the voltage applied to the common electrode according to said difference between said desired charge on the display electrode and said actual charge on the display electrode.

9. A common electrode control circuit according to claim 8, wherein the liquid crystal display includes a display driver circuit configured to provide a plurality of display signals to the display electrode, said detector includes a monitoring circuit configured to monitor a magnitude of the display signals, and said voltage controller is configured to adjust the voltage applied to the common electrode according to said magnitude of the display signals.

10. A common electrode control circuit according to claim 9, wherein said voltage controller is configured to adjust the voltage applied to the common electrode according to an average of a maximum magnitude and a minimum magnitude of the display signals.

11. A common electrode control circuit according to claim 10, wherein the display signals include a gate signal, said detector is configured to determine a magnitude of the gate signal, and said voltage controller is configured to adjust the voltage applied to the common electrode according to said average and said magnitude of the gate signal.

12. A common electrode control circuit according to claim 11, wherein the liquid crystal display includes a liquid crystal layer, and further comprising:

a temperature sensor configured to generate a temperature signal corresponding to a temperature of the liquid crystal layer; and wherein said voltage controller is further connected to the temperature sensor and responsive to said temperature signal, and is configured to adjust the voltage applied to the common electrode according to said average of said average, said magnitude of the gate signal, and said temperature signal.

13. A common electrode control circuit according to claim 9, wherein the display signals include a gate signal, said detector is configured to determine a magnitude of the gate signal, and said voltage controller is configured to adjust the voltage applied to the common electrode according to said magnitude of the gate signal.

14. A common electrode control circuit according to claim 13, wherein the liquid crystal display includes a liquid crystal layer, and further comprising:

a temperature sensor configured to generate a temperature signal corresponding to a temperature of the liquid crystal layer; and wherein said voltage controller is connected to the temperature sensor and responsive to said temperature signal and is configured to adjust the voltage applied to the common electrode according to said magnitude of the gate signal and said temperature signal.

15. A common electrode control circuit according to claim 8, wherein the liquid crystal display includes a liquid crystal layer, and further comprising:

a temperature sensor configured to generate a temperature signal corresponding to a temperature of the liquid crystal layer; and wherein said voltage controller is connected to the temperature sensor and responsive to said temperature signal and is configured to adjust the voltage applied to the common electrode according to said temperature signal.

16. A method of controlling a voltage applied to a common electrode of a liquid crystal display having a display driver circuit operatively connected to a display electrode, the common electrode and the display electrode having a liquid crystal layer therebetween, comprising the steps of:

providing a desired charge through respective switching elements to the display electrode;

applying a drive signal to a switching control of the respective switching elements, receiving a compensating error charge through the common electrode, the error charge being indicative of a parasitic capacitance of the switching control of the respective switching elements on the display electrode relative to a capacitance of the liquid crystal layer;

substantially continuously determining a present magnitude of a variable difference between said desired charge and the error charge; and dynamically adjusting the voltage applied to the common electrode according to said present magnitude of said variable difference.

17. The method of claim 16, wherein the display driver circuit generates display signals having a maximum magnitude and a minimum magnitude, wherein:

said step of substantially continuously determining said present magnitude includes determining an average of the maximum magnitude and the minimum magnitude; and said step of dynamically adjusting the voltage includes adjusting the voltage according to said average.

18. The method of claim 16, wherein the display driver circuit generates a gate signal, wherein:

said step of substantially continuously determining said present magnitude includes determining a magnitude of the gate signal; and said step of dynamically adjusting the voltage includes adjusting the voltage according to said magnitude of the gate signal.

19. The method of claim 16, wherein the liquid crystal display includes a liquid crystal layer, wherein:

said step of substantially continuously determining said present magnitude includes determining a temperature of the liquid crystal layer; and said step of dynamically adjusting the voltage includes adjusting the voltage according to said temperature.

20. The method of claim 16, wherein the liquid crystal display includes a liquid crystal layer and the display driver circuit generates display signals having a maximum magnitude and a minimum magnitude and a gate signal, wherein:

said step of substantially continuously determining said present magnitude includes the steps of:

determining an average of the maximum magnitude and the minimum magnitude;

determining a magnitude of the gate signal; and determining a temperature of the liquid crystal layer; and said step of dynamically adjusting the voltage includes adjusting the voltage according to said average, said magnitude of the gate signal, and said temperature.

* * * * *